United States Patent [19]

Kurpanek

[11] 4,230,963

[45] Oct. 28, 1980

[54] HYDRO-THERMIC ENERGY CONVERTER

[76] Inventor: Waldemar H. Kurpanek, Mercatorstr. 3, D-4000 Duesseldorf-11, Fed. Rep. of Germany

[21] Appl. No.: 867,971

[22] Filed: Jan. 9, 1978

[51] Int. Cl.[3] ..... H01J 45/00

[52] U.S. Cl. ..... 310/306; 60/641; 308/10

[58] Field of Search ..... 310/306; 308/10; 60/641

[56] References Cited

U.S. PATENT DOCUMENTS

| | | | |
|---|---|---|---|
| 380,100 | 3/1888 | Edison | 310/306 X |
| 428,057 | 5/1890 | Tesla | 310/306 |
| 476,983 | 6/1892 | Edison | 310/306 |
| 481,999 | 9/1892 | Berliner | 310/306 |
| 1,431,545 | 10/1922 | Schwartz | 310/306 |
| 3,909,082 | 9/1975 | Ishikawa et al. | 308/10 |
| 4,047,093 | 9/1977 | Levoy | 60/641 X |

*Primary Examiner*—Donovan F. Duggan

[57] ABSTRACT

A hydro-thermic energy converter capable to convert thermal energy contained in hot water in mechanical energy by utilizing the low Curie-temperature property of ferromagnetic alloys in a directional magnetic field alternation of the ferromagnetic property of said alloy such that a magnetic one-directional tractive force resolves.

10 Claims, 3 Drawing Figures

HYDRO-THERMIC ENERGY CONVERTER

BACKGROUND OF THE INVENTION

It is well known that ferromagnetic alloys lose their ferromagnetic property above a specific Curie-temperature.

It is also well known how to produce various ferromagnetic alloys of a different specific Curie-point. Typical application of such ferromagnetic alloys are found among other in electricity counters, relays, switches, electric motors, etc. where through a magnetic shunt eighter the effective magnetic flux of the magnetic system is held constant or a defined increase of the effective magnetic flux with a respective temperature is attained.

Furthermore there are thermo energy converter known such as: the Stirlingmotor, Solarmotor, Banks-Engine, etc. which mainly have the disadvantages, that they are complicated or climate dependant such as the solarmotor, or that an additional auxiliary energy source is needed.

To make a ferromagnetic disk turn in a directional magnetic field by changing its ferromagnetic property with the aid of say a blow lamp or a hot gas is also well known.

SUMMARY OF THE INVENTION

The object of the present invention is to demonstrate a hydro-thermic energy converter capable to convert thermal energy contained in hot water in mechanical rotational energy and afterwards in electrical energy. It is further the aim of the present invention to produce a hydro-thermic energy converter utilizing the hot waste water of fossil and nuclear power plants and thereby increasing the general power output of conventional power plants.

Furthermore, it is the object of the present invention to demonstrate a geothermal low temperature power plant comprising a number of said power plants arranged above each other with separate fully closed hot- and cool water circulation tubing.

Contrary to the geothermal hydraulic fracturing process where the water reacts directly with the hot rock thereby fracturing the rock and washing out soluble salts and gases, such as: Potassium, Mercury, Arsenic, Chloride, Carbon-dioxide, Hydrogen-sulphide, etc. and which are then ejected into a near river, the present invention shows an environment pollution free process by using lined fully closed water circulation tubing where the used water is continously reinjected.

The lined tubing prevents also a subsidence of the ground and seismic reaction as found by using the hydraulic fracturing process.

Summarized, the objects of the instant invention have been attained by constructing the hydro-thermic energy converter comprising, a rotor and a stator unit. The rotor unit comprises a rotatory mounted rotor arm on the end of which permanent magnets or electromagnets are mounted such that the poles of the magnets face each other with opposing poles and are bridged by a U-shaped magnetic flux conductor.

The poles of the magnets can also be arranged such that the poles of both magnets face with equal magnetic polarity in the direction of rotation.

To prevent excessive friction the ends of the rotor move on free floating magnetic bearings.

The stator unit comprises a large number of ferromagnetic chamber plates arranged radially within the ring-shaped stator unit.

The walls of the stator and the ferromagnetic chamber plates are arranged such that separate chambers are formed.

The chambers can be flushed with hot or cool water through a in- and outlet-tubing with a respective inlet valve and vent pipe.

The chambers are arranged such that after every hot flushed chamber a cool flushed chamber follows with individual valve, in- and outlet-tubing and vent pipe. The chamber plates consist of a ferromagnetic alloy with a low Curie-point of approx. 30° C. The stator unit is constructed such that the magnets move above and below the stator unit without contact.

The temperature of the hot water has to be above the Curie-temperature of the ferromagnetic chamber plates due to the fact that the Curie-point of a ferromagnetic material in a directed magnetic field is dependent on that magnetic field strength.

The field strength dependance of a ferromagnetic (Fe, Ni) alloy with a Curie-point of 30° C. within a magnetic field of a field strength of 100 A/cm amounts to approx. 10 mT/°C.

Magnetic resistors mounted one on each chamber generate a electric trigger impulse to switch the respective valve as soon as the magnetic field of the rotor magnets sweeps across.

The valves should preferrably be magnetic bistable valves that need no electric holding current.

As soon as the respective chambers enter the magnetic field of the rotor magnets the valves of the cool water chambers close and the chambers run empty whereas the valves of the hot water chambers open to be flushed with hot water.

As the chambers move out of the magnetic field the process is reversed. Due to the fact that all chamber plates between the rotor magnets have lost their ferromagnetic property due to the hot water and regain the ferromagnetic property slowly a distance outside of the magnetic field of the rotor magnets, the magnetic field of the rotor magnets is forced to close over the nearer cool ferromagnetic chamber plates ahead of the rotor magnets thus creating a one-directional magnetic tractive force in the direction of rotation. Due to the fact that separate chambers are used for hot and cool water, thus a fully separate hermetically sealed hot and cool water circulation is achieved.

Other arrangement can also be employed.

The hermetically sealed water circulation makes it also possible to work with higher internal pressures so that a higher boiling point of water can be employed. To realize a fully recycling and pollution free geothermal low temperature power plant connecting sloping lined tubes should be run 1.5 to 2.5 km deep into the ground.

The lined tubes prevent that salts and gases enter the circulation. The conduction of heat out of the rocks for such low temperatures is high enough especially due to the fact that warm used water is being reinjected into the circulation. Due to the fact that the used warm water is reinjected into the hot water circulation, the erection of such a power plant becomes geographically independent and furthermore no rivers need to be polluted.

For the cold water circulation a large cold water reservoir suffices.

BRIEF DESCRIPTION OF THE DRAWINGS

Other and further objects of the instant invention will become more apparent from the following detailed description of the various embodiments thereof when taken with reference to the appended drawings in which like characters refer to like structure and in which.

DETAILED DESCRIPTION OF A PREFERRED EMBODIMENT

Figure 1:
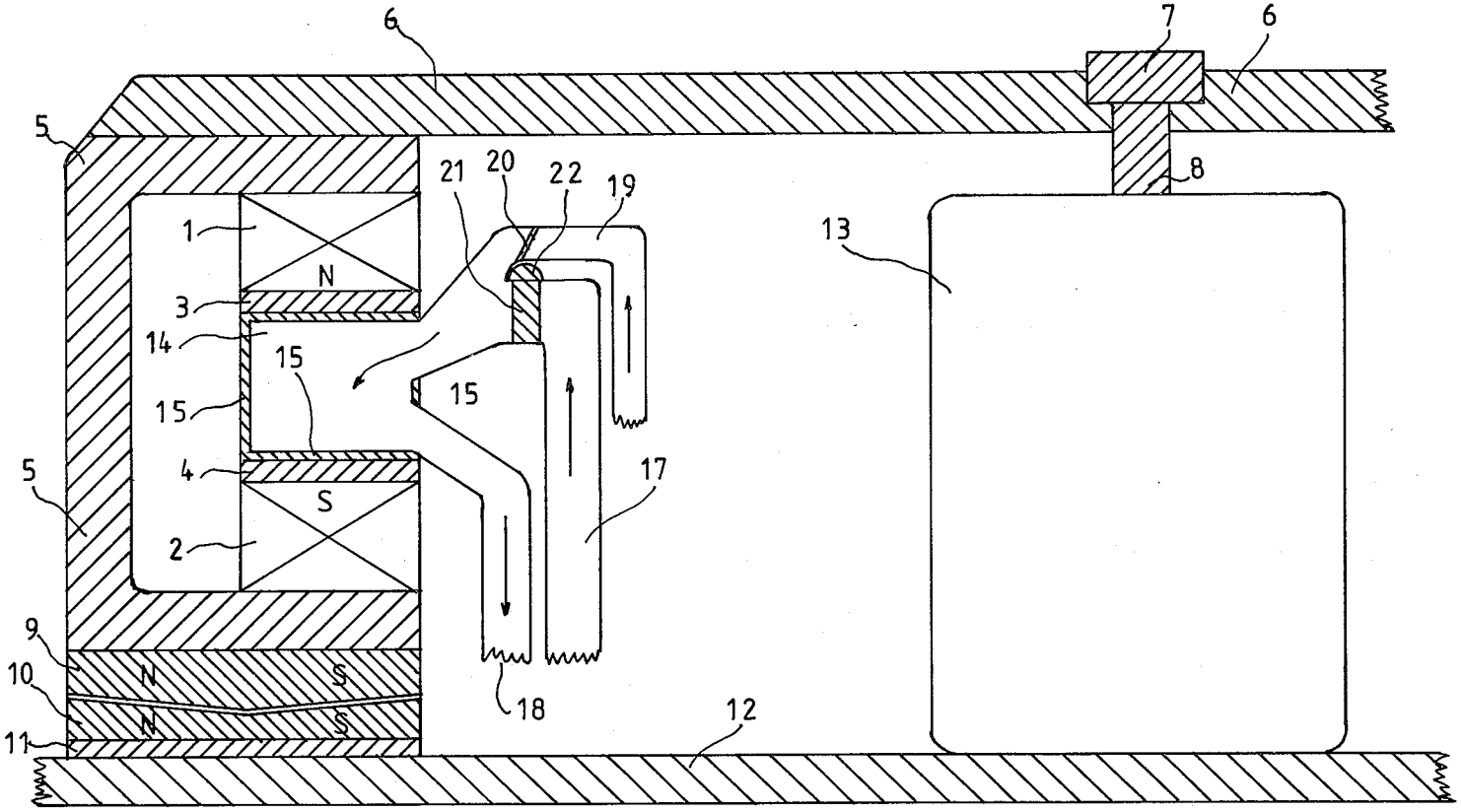
FIG. 1 shows a side sectional view of the hydro-thermic energy converter.
Figure 2:
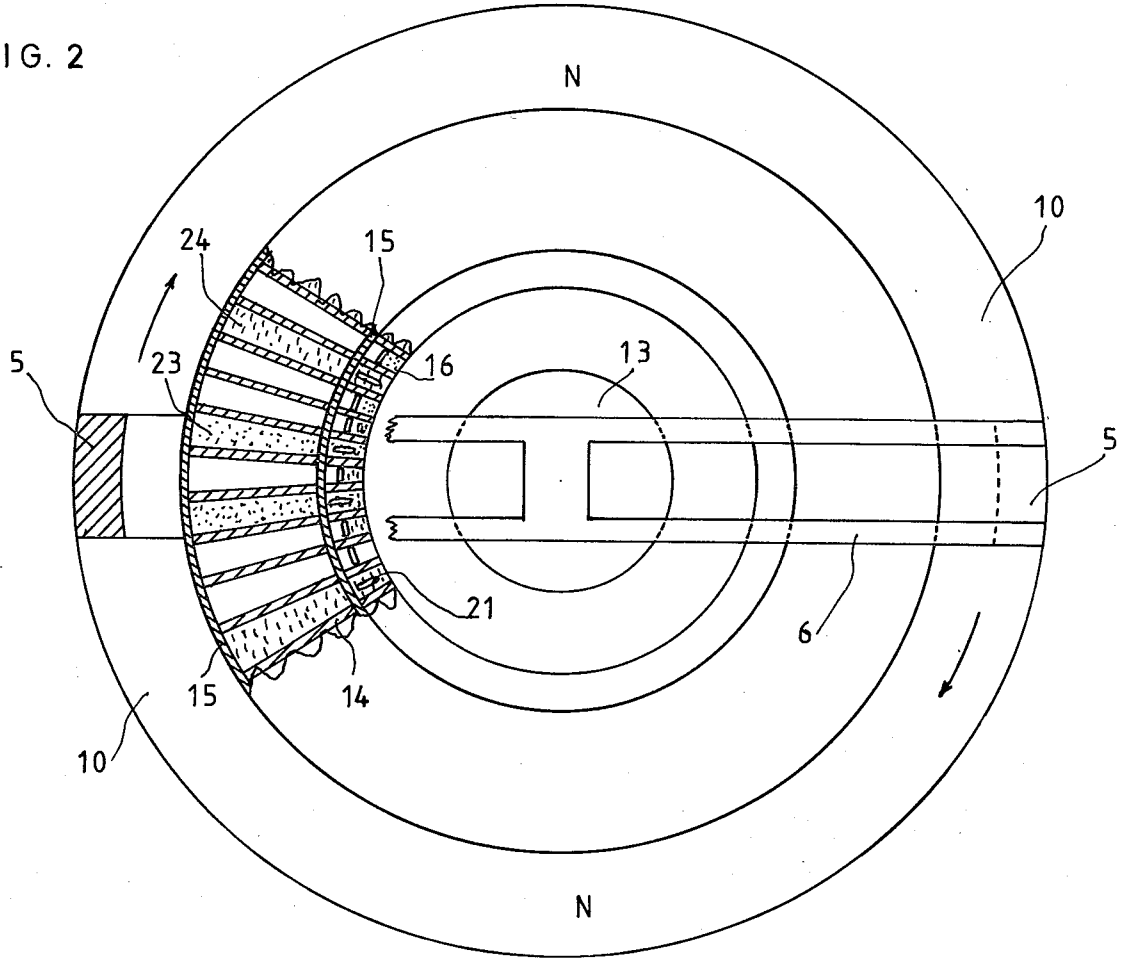
FIG. 2 shows a cut away top view of the hydro-thermic energy converter.

As illustrated in FIGS. 1 and 2 the instant invention comprises a rotor and a stator unit.

The rotor unit comprises the rotor arm 6, which is connected with the center piece 7 to the rotatable center axis 8 of a generator housing 13. The generator and the step up gear are not shown.

On the end of the rotor arm 6 a U-shaped magnetic flux conductor 5 with magnets 1 and 2 and pole pieces 3 and 4 are mounted. The stator unit comprises, the ground plate 12 on which the stator unit with the chamber plates 14, the chamber walls 15 and 16, the in- and outlet tubing 17 and 18 and the vent pipe 19 are rigidly mounted.

The chambers are arranged such, that after every hot chamber 23 (in FIG. 2 indicated by dots) a cool chamber 24 (in FIG. 2 indicated by dashes) follows, with respective open or closed valve flaps 21.

Every chamber 23, 24 contains a separate vent pipe 19 with return flap 20 and a valve system comprising valve head 22, and valve flap 21.

Furthermore to each chamber 23, 24 leads a separate in- and outlet tubing 17 and 18 so that a hermetically sealed hot and cool water circulation can be established. The chamber plates 14 consist of a ferromagnetic alloy with a low Curie-point, the chamber walls 15, 16, the in- and outlet tubing 17, 18 and the vent pipe 19 should preverrably be of a magnetism and heat non-conductive material.

The magnetic field resistors are not shown in the drawings.

To prevent excesive friction the rotor floates on permanent magnets 9 and 10.

On the ground plate 12 the permanent magnet 10 pole piece 11 is rigidly mounted and on the rotor unit the permanent magnet 9 with opposing magnetic poles is attached.

Figure 3:
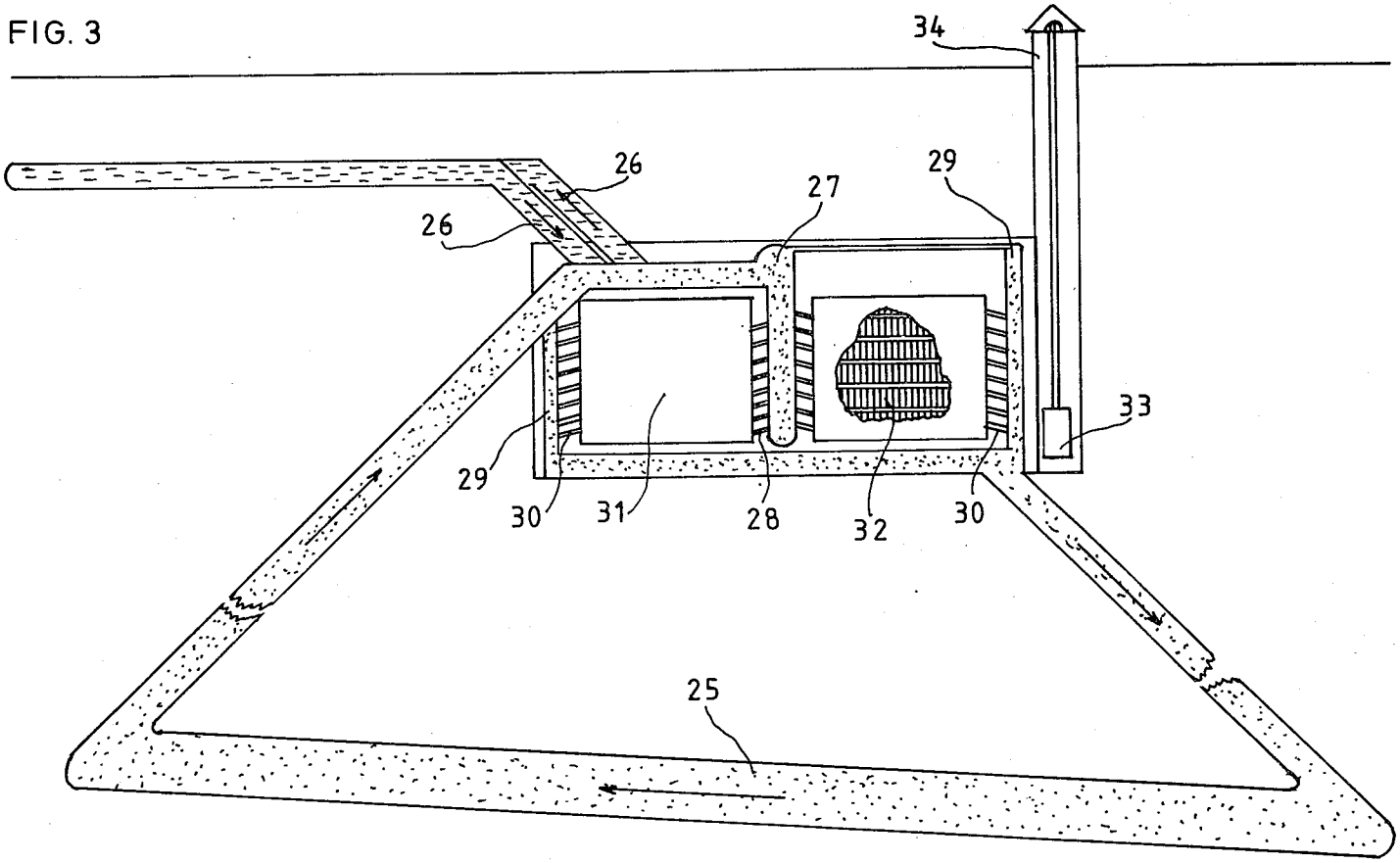
FIG. 3 shows a side sectional view of the hydro-thermic energy converter as a underground geothermal low temperature power plant.

FIG. 3 shows a schematic side view of a underground geothermal low temperature power plant with a hot water circulation 25 and a cool water circulation 26 with gas collecting tanks 27 and 29. 31, 32 shows a number of hydro-thermic energy converters arranged above each other with hot water inlet tubing 28 and hot water outlet tubing 30. The cool water in- and outlet tubing ist not shown.

An elevator building 34 with elevator cabin 33 is shown on the side of the power plant.

It will be manifestly appreciated by those skilled in the art that the hydro-thermic energy converter can be employed in various form.

It should be understood therefore that the various embodiments herewith described and disclosed have only been shown by way of example and other and further modifications of the instant invention may be made without avoiding the spirit or scope thereof.

The embodiment of the instant invention in which an exclusive property or privilege is claimed is defined as follows.

1. A hydro-thermic energy converter capable to convert energy contained in hot water in mechanical energy comprising, a ring-shaped stator unit consisting of a radially arranged chamber system with ferromagnetic chamber plates of a low Curie-point and a(in-) inlet and an outlet tubing system with valves and vent pipe to permit a flushing of the chamber system with hot (and) or cool water thus permitting alternate heating (and) or cooling the said ferromagnetic chamber plates respectively above (and) or below (their) the Curie-point and that furthermore a rotor system consisting of at least one rotatable mounted rotor arm (with) on which magnets are arranged such that a directional magnetic field is established between which the stator unit slides thus generating a rotational force without contacting the magnets.

2. A hydro-thermic energy converter as claimed in claim 1 wherein each chamber is connected with a respective hot or cool hermetically sealed water circulation.

3. A hydro-thermic energy converter as claimed in claim 1 wherein every second chamber is connected to a hot water circulation and the inbetween chambers are connected to the cool water circulation.

4. A hydro-thermic energy converter as claimed in claim 1 wherein more than one rotor arm with respective magnets are employed.

5. A hydro-thermic energy converter as claimed in claim 1 wherein the magnets face with opposite magnetic poles.

6. A hydro-thermic energy converter as claimed in claim 1 wherein the magnets face with equal magnetic poles in the direction of rotation.

7. A hydro-thermic energy converter as claimed in claim 1 wherein the magnets are permanent magnets and are bridged with a magnetic flux conductor.

8. A hydro-thermic energy converter as claimed in claim 1 wherein the magnets are electro magnets and are bridged by a magnetic flux conductor.

9. A hydro-thermic energy converter as claimed in claim 1 wherein the ends of the rotor float on magnetic bearings.

10. A hydro-thermic energy converter as claimed in claim 1 wherein magnetic field resistors control the valve action.

* * * * *